United States Patent [19]
Jönsson

[11] Patent Number: 4,825,910
[45] Date of Patent: May 2, 1989

[54] BATTEN FOR A HAND LOOM

[75] Inventor: Karl S. Jönsson, Kungsgarden, Sweden

[73] Assignee: FA Konsult AB, Arvika, Sweden

[21] Appl. No.: 201,196

[22] Filed: Jun. 2, 1988

Related U.S. Application Data

[63] Continuation of Ser. No. 68,247, Jun. 17, 1987.

[30] Foreign Application Priority Data

Oct. 18, 1985 [SE] Sweden ..... 8504891
Oct. 17, 1986 [WO] PCT Int'l Appl. ... PCT/SE86/00485

[51] Int. Cl.[4] ..... D03D 29/00
[52] U.S. Cl. ..... 139/29
[58] Field of Search ..... 139/29, 30, 188 R, 190, 139/191

[56] References Cited

U.S. PATENT DOCUMENTS 1,225,446 5/1917 Lewis ..... 139/33
1,274,948 8/1918 Shook ..... 139/30

FOREIGN PATENT DOCUMENTS 182361 11/1954 Austria ..... 139/29
182365 11/1954 Austria ..... 139/29

*Primary Examiner*—Henry S. Jaudon
*Attorney, Agent, or Firm*—Burns, Doane, Swecker & Mathis

[57] ABSTRACT

Loom having a reciprocating batten device comprising a reed and a first handle fixed on the batten device for manually reciprocating the batten device. According to the invention the loom is provided with a second handle which is journalled on the batten device and acts on a mechanism comprising a gripping device which during the movement of the second handle engages the stationary part of the loom, and a mechanism which transfers the movement of the second handle to the batten device.

8 Claims, 2 Drawing Sheets

Fig. 1
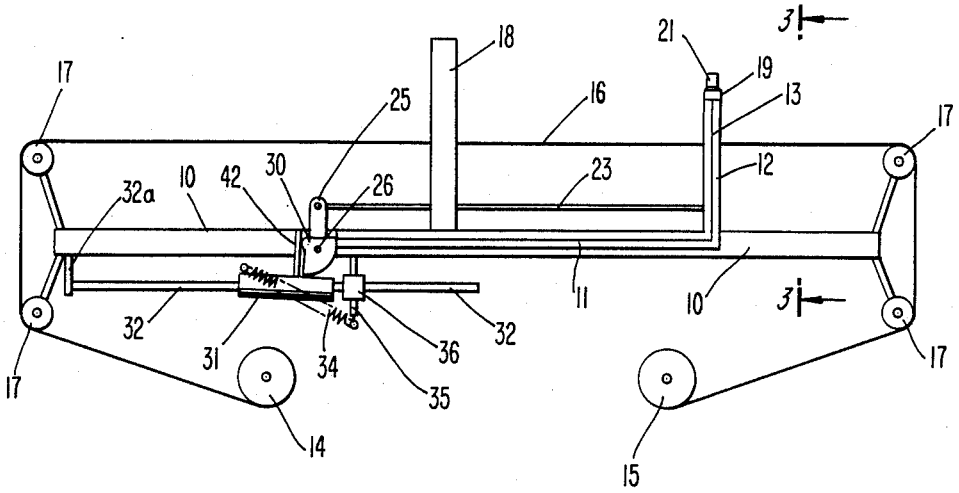
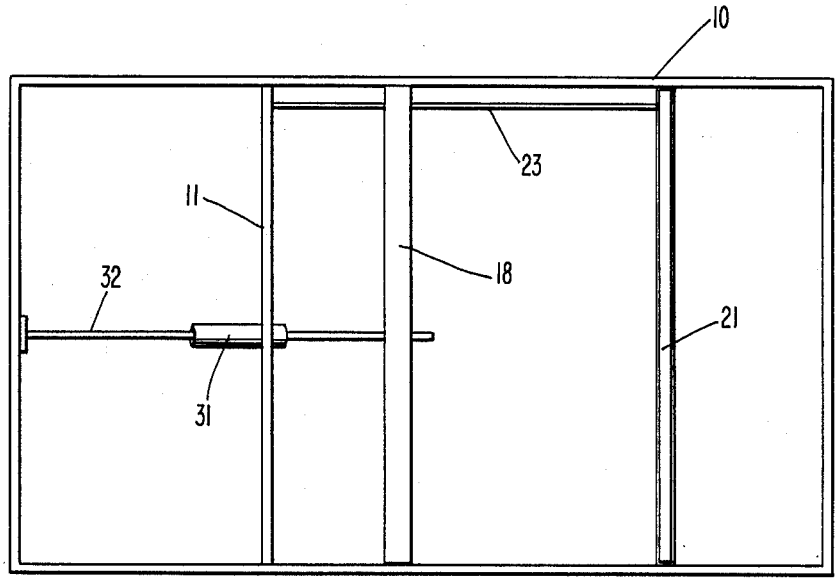
Fig. 2

BATTEN FOR A HAND LOOM

This application is a continuation of application Ser. No. 068,247 filed June 17, 1987.

BACKGROUND OF THE INVENTION

After a weft thread in a loom has been introduced into a shed, it is brought to its final position by a reed which is mounted on a batten. In order to give the motion of the batten a sufficient pressure towards the cloth, the batten is given a certain weight which by the swinging motion of the batten provides an impact action thus pressing the weft thread into contact with the edge of the cloth. In small looms, the batten often cannot be given a sufficient weight for providing the necessary impact and the batten must be pressed by hand against the edge of the cloth. This results in a reduced beating-up capacity so that certain types of cloths, e.g. carpets, cannot be produced in a small loom. There is a problem in connection with larger looms as well in that the impact of the batten against the edge of the cloth gives a loud thumping sound. This prevents the use of the loom in apartment buildings because the sound is too disturbing to other occupants. Finally, there is a problem in the use of weaving as therapy work because many patients' arms are too weak to adequately impact the batten.

SUMMARY OF THE INVENTION

The present invention aims at a solution of these problems by providing the batten with a servo mechanism which, by exerting a small force, gives a high pressure to the reed in the last phase of motion of the reed towards the edge of the cloth. Closer details of the invention appear from the following specification and drawings which disclose an embodiment of the invention. The drawing figures show the following.

BRIEF DESCRIPTION OF THE DRAWINGS

FIG. 1 is a longitudinal section of a loom according to the invention.

FIG. 2 is a top view of the loom in FIG. 1.

DESCRIPTION OF THE PREFERRED EMBODIMENT

Figure 3:
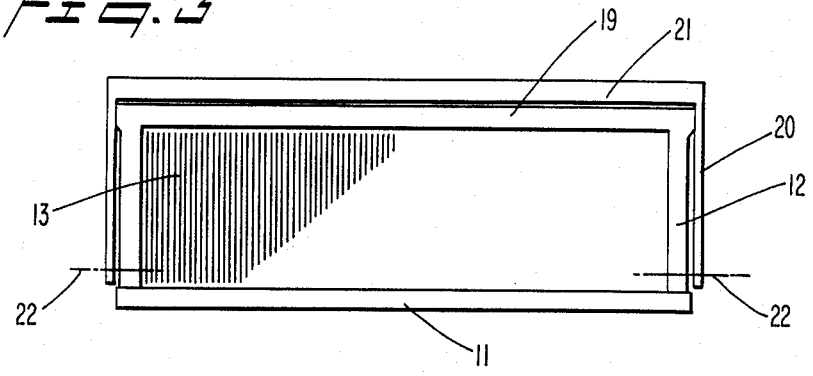
FIG. 3 is a section of the loom on the line 3—3 in FIG. 1.

The loom in FIG. 1 comprises a horizontal frame 10 and a batten carriage comprising a second horizontal frame 11 reciprocally movable on frame 10. Frame 11 carries rigidly connected thereto a vertical frame consisting of vertical bars 12 and an upper transverse horizontal bar 19. The frame 12, 19 is adapted to receive a reed 13. The loom has a warp beam 14 and a cloth beam 15 with a cloth 16 tensioned therebetween over deflector rolls 17. A vertical frame 18 is rigidly mounted on frame 10 and is adapted to carry heddles (not shown).

The present invention includes a mechanism which renders it possible to give a greater exertive force to the final beating-up motion. This mechanism will now be described.

Figure 5:
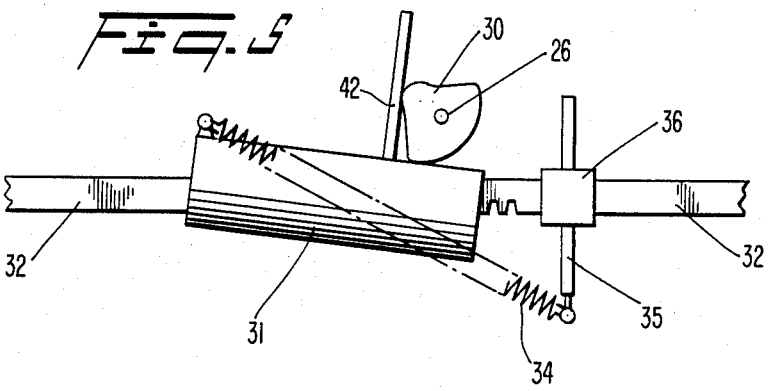
Figure 6:
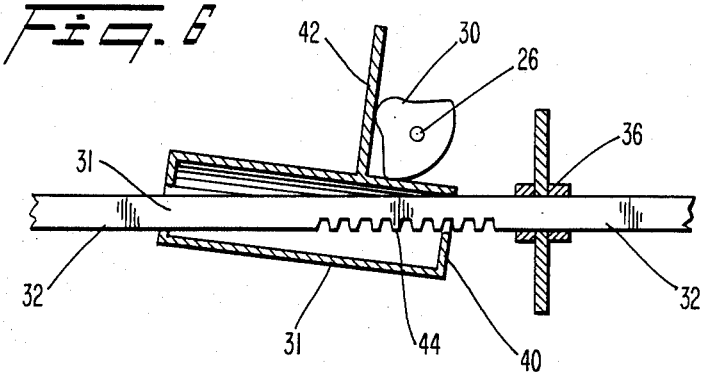

As shown in FIG. 3, the frame 12, 19 has a second vertical frame pivotally mounted on lugs 22 and having vertical side bars 20 and a horizontal top bar 21. Frame 20, 21 is connected to the special beating-up mechanism shown in FIGS. 4–8 by a link rod 23 which is connected to the frame 20, 21 by a pivot joint 24. At its other end the rod 23 is connected by a second pivot joint 24*a* to a second lever arm 25, which is rigidly attached to a shaft 26 journalled in the batten carriage 11. The shaft 26 carries at its middle between the sides of the loom a cam disc 30 rigidly connected to the shaft 26. This cam disc cooperates with a gripping device in the form of a locking sleeve 31, which is mounted on a rack bar 32 in such a way that the sleeve can adopt a sliding position or a locked position in relation to the rack 32. The rack is rigidly secured to the loom frame 10 by a projection 32*a*. FIG. 6 shows the sleeve 31 in section, the left end of the sleeve having a rounded mouth 33, adapted to slide along the rack 32.

The positions of the sleeve above mentioned, the sliding position and the locked position, are determined by the position of the right hand end of the sleeve as seen in the figures. The sliding position is shown in FIGS. 5 and 6 where the right hand end of the sleeve is lowered so that the projection 40 does not mesh with the teeth 44 of the rack, and the sleeve is free to slide along the rack. The locked position is shown in FIGS. 7 and 8, where the right hand end meshes with the teeth 44 of the rack, thus locking the sleeve from sliding along the rack.

These two positions of the sleeve are determined by the cam disc 30, the position of which is set by the pivotable frame 20, 21 through the link system consisting of joint 24, rod 23, lever arm 25 and the axis 26.

The locking sleeve 31 is provided with a spring 34 acting between the left hand end of the sleeve and a projection 35 on a sleeve 36 rigidly attached to the batten carriage 11 and serving as a support for the rack 32. The spring 34 exerts a bias on the sleeve striving to rotate the right-hand end of the sleeve around the disc 30 as the rotation center. In FIGS. 5 and 6 this rotation is prevented by the disc 30, the position of which in these figures corresponds to the vertical position of the frame 20, 21.

Figure 4:
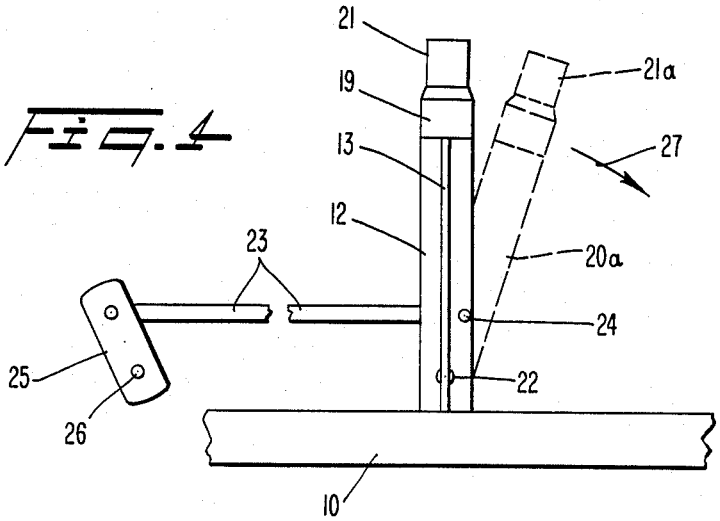
FIGS. 4–8 are details of the loom in FIGS. 1 and 2.
Figure 7:
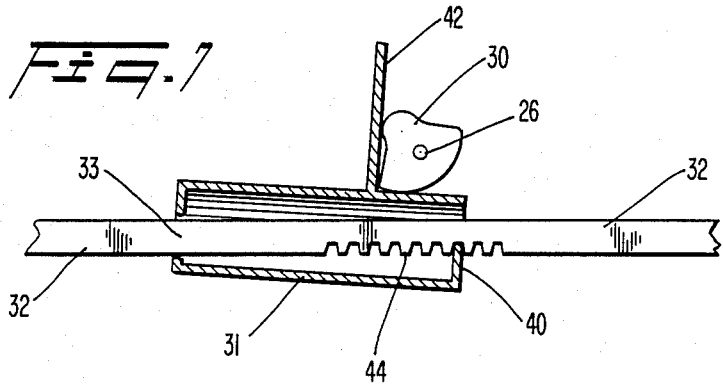
Figure 8:
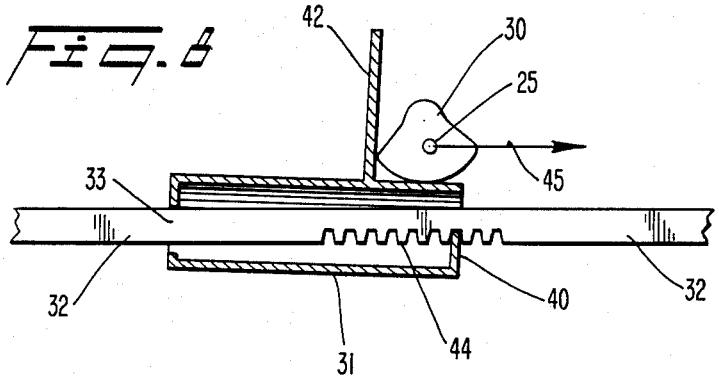

When the frame 20, 21 is swung towards the operator along the arrow 27 to the inclined position 20*a*, 21*a* drawn with dashed lines in FIG. 4, the disc 30 first takes the position shown in FIG. 7, and during further turning of the disc 30, the lower left corner of the disc 30 exerts pressure on the projection 42 on the sleeve 31. As the sleeve in this position is locked and cannot slide along the rack, the result is that the disc 30 together with axis 26 and the whole batten carriage 11 is pushed to the right as indicated by the arrow 45 in FIG. 8. This motion of the carriage presses the reed against the edge of the weft, thus pressing the last inserted weft thread to the bottom of the shed.

In summation, the sleeve 31 can be moved together with the batten carriage 11 or can be locked in an arbitrary position along the path of the carriage. In the locked position, the locking sleeve serves as a support for the servo mechanism which performs the final phase of the movement of the carriage.

It is noted that the servo mechanism does not prevent the use of the loom in a conventional way. As long as the frame 20, 21 is held vertical, the servo mechanism including the locking sleeve 31 does not partake in the weaving.

OPERATION

During the first stage of the beating-up motion, both top bars 19 and 21 are held by hand and the carriage 11 is pulled on guides (not shown) so that the reed 13 is brought into contact with the edge of the cloth. During a second phase, the operator releases the lower top bar 19 and pulls only the upper top bar 21. The lower top bar 21 swings toward the operator around the joint 22 towards the position 20*a* and 21*a* as indicated by the arrow 27 and dashed lines in FIG. 4.

The first phase motion of the frame 20, 21 causes the sleeve 31 to mesh with the rack 32 thus preventing the sleeve from further sliding along the rack. In the second phase of the motion of frame 20, 21 the cam disc 30 exerts pressure on projection 42 on the locked sleeve thus urging the reed against the edge of the weft.

I claim:

1. A loom comprising a reciprocating batten having a reed, a first handle rigidly mounted on the batten for performing a reciprocating motion by hand, a second handle arranged on the batten and adapted to act on a mechanism comprising a gripping element, said gripping element being adapted to move with said batten and to be made immovable by engagement of said gripping element with a stationary part of the loom, said mechanism providing support for transferring movement of said second handle to the batten when said gripping element is made immovable.

2. A loom as defined in claim 1, wherein the second handle actuates a cam disc disposed on the batten, said disc acting on the gripping element, said gripping element including a sleeve resiliently connected to the batten, said sleeve being slidable along a rack fixed to the frame of the loom, said sleeve being rendered immovable upon engagement with the rack during an initial state of movement of the second handle, said cam disc being adapted to cause movement of the batten towards the edge of a cloth by a projection disposed on said mechanism when said sleeve is rendered immovable and movement of the second handle continues beyond said initial state.

3. A loom as defined in claim 2, wherein the first handle is a rod placed along the reed and the second handle is a rod situated along the first handle so that it is possible to grip both handles at the same time or to grip the second handle only.

4. A loom as defined in claim 1, wherein the first handle is a rod placed along the reed and the second handle is a rod situated along the first handle so that it is possible to grip both handles at the same time or to grip the second handle only.

5. A loom comprising:

a batten having a reed;

a first handle means rigidly mounted on the batten for performing a reciprocating motion of the batten;

a second handle means releasably disposed on the first handle means for performing additional reciprocating motion of the batten;

first means interposed between said second handle means and said batten and adapted for transferring a relative movement between said second handle means and said first handle means to said batten, said first means comprising a gripping element, said gripping element having a first position wherein the gripping element is movable with the batten during joined movement of the first handle means and the second handle means, and a second position wherein the gripping element is fixed to the loom during relative movement between the second handle means and the first handle means, said gripping element, when in said second position, providing support for transferring said relative movement to said batten.

6. A loom as claimed in claim 5, wherein the gripping element is a sleeve journalled on a stationary rack fixed to the loom, said sleeve being slidable along the rack in said first position and being engaged with the rack in said second position;

said first means comprising a cam disc and a projection, said projection rigidly attached to said sleeve and providing an opposing surface for said cam disc, said cam disc being connected to said second handle means and actuatable thereby, said cam disc having an initial actuation which exerts pressure on said sleeve to move said sleeve to said second position and having a secondary actuation which exerts pressure on said projection causing movement of said batten.

7. A loom as claimed in claim 6, wherein the first handle means comprises a rod placed along the reed and the second handle means comprises a rod releasably situated along the first handle means thus allowing gripping of both handle means simultaneously or gripping of the second handle alone.

8. A loom as claimed in claim 5, wherein the first handle means comprises a rod placed along the reed and the second handle means comprises a rod releasably situated along the first handle means thus allowing gripping of both handle means simultaneously or gripping of the second handle alone.

* * * * *